US007070219B1

(12) United States Patent
Kelly

(10) Patent No.: US 7,070,219 B1
(45) Date of Patent: Jul. 4, 2006

(54) METHOD AND APPARATUS FOR LIFTING A TRAILER

(75) Inventor: Thomas P. Kelly, Colleyville, TX (US)

(73) Assignee: BNSF Railway Company, Fort Worth, TX (US)

( * ) Notice: Subject to any disclaimer, the term of this patent is extended or adjusted under 35 U.S.C. 154(b) by 290 days.

(21) Appl. No.: 10/746,443

(22) Filed: Dec. 23, 2003

Related U.S. Application Data

(60) Provisional application No. 60/436,377, filed on Dec. 23, 2002.

(51) Int. Cl.
*B66C 1/20* (2006.01)

(52) U.S. Cl. ..... 294/81.5; 294/67.3; 294/904

(58) Field of Classification Search ..... 294/81.1, 294/81.2, 81.5, 81.51, 81.55, 81.56, 67.1, 294/67.3, 67.31, 67.4, 67.41, 904; 414/426, 414/563; 410/30; 188/32
See application file for complete search history.

(56) References Cited

U.S. PATENT DOCUMENTS 2,920,917 A * 1/1960 Sheehan ..... 294/81.51
3,695,394 A * 10/1972 Carpenter ..... 188/32
3,752,083 A * 8/1973 Bitterberg ..... 105/26.05
3,897,879 A * 8/1975 Bubik ..... 414/563
4,232,893 A * 11/1980 Kijewski ..... 294/103.1
4,657,468 A * 4/1987 Youmans et al. ..... 414/563
4,934,489 A * 6/1990 Jackson ..... 188/2 R
5,540,540 A * 7/1996 Peterson ..... 414/563

* cited by examiner

*Primary Examiner*—Dean J. Kramer
(74) *Attorney, Agent, or Firm*—Thompson & Knight LLP; James J. Murphy; Richard L. Wynne, Jr.

(57) ABSTRACT

A lifting apparatus for use in lifting a trailer from a railcar, wherein the trailer includes a tandem rear axel with wheel assemblies having tires coupled thereto, for use in combination with an overhead crane having a plurality of lifting shoes for engaging the trailer at a plurality of lifting points. The lifting apparatus includes a connector member for connecting the lifting apparatus to a lower portion of particular ones of the plurality of lifting shoes and a retaining member for engaging the tandem rear axel and a particular one of the wheel assemblies in order to secure the particular one of the wheel assemblies in a fixed position and to bear the weight of the tandem rear axel and the wheel assemblies. The lifting apparatus also includes an adjustment member for determining an amount of engagement between the retaining member and the tandem axel and the particular one of the wheel assemblies. The adjustment member includes a mechanical biasing subassembly which urges the retaining member into mechanical engagement with the tandem rear axels with wheel assemblies. A mechanical linkage is provided for mechanically connecting the connector member, the retainer member and the adjustment member.

16 Claims, 5 Drawing Sheets

METHOD AND APPARATUS FOR LIFTING A TRAILER

CLAIM OF PRIORITY

This application claims the benefit of U.S. Provisional Patent Application Ser. No. 60/436,377, filed 23 Dec. 2002, entitled "METHOD AND APPARATUS FOR LIFTING A TRAILER." This provisional application is incorporated herein as if fully set forth.

BACKGROUND OF THE INVENTION

1. Field of the Invention

The present invention relates to lifting trailers. In particular, the present invention is related to lifting tandem-axle trailers having air ride suspension systems.

2. Description of Related Art

Almost all of the cargo freight transported throughout the United States is carried for at least a portion of its journey by tractor trailers. The trailers used in this type of shipping typically have tandem rear axles. Many of these trailers now utilize air ride suspension systems, in which air bags are used as shock absorbers.

Many years ago, the railroad industry began offering "intermodal" transportation services in which cargo trailers are loaded onto flatbed railcars and transported by rail. The trailers are typically loaded onto the flatbed railcars by overhead cranes having arms that extend downward and terminate with lifting shoes, or hooks. The lifting shoes are configured to connect to the trailer below the lower side edges of the trailer. Usually the arms are positioned so that there is one lifting shoe on each side of the front end of the trailer and one lifting shoe on each side of the rear end of the trailer. This allows the weight of the trailer and its cargo to be distributed across the four arms of the overhead crane.

In a typical intermodal operation, a trailer is positioned near a flatbed railcar. Then, an overhead crane is positioned over the trailer, such that two lifting shoes are positioned on either side of the front end of the trailer and two lifting shoes are position on either side of the rear end of the trailer. The lifting shoes are then secured to the trailer and the trailer is lifted and placed onto the flatbed railcar. Once the trailer is placed onto the flatbed railcar, it is secured into a locking hitch assembly on the railcar so that it does not move.

However, air ride suspension trailers cannot be lifted unless the axle remains in a fixed vertical position. If the axle lowers during lifting, the air bags will stretch and can be damaged. In addition, if the trailer is raised and the air bags are allowed to stretch under the weight of the axles and wheel assemblies, the air bags can be misaligned and damaged when the trailer is lowered again.

Although there have been many developments in the area of intermodal transportation, many shortcomings remain.

SUMMARY OF THE INVENTION

One problem that exists in the intermodal transportation industry is that when trailers are lifted by overhead cranes, there is no support for the wheel assemblies. This is a particular problem with trailers that have air ride suspension systems, because when the trailer is lifted by the overhead crane, the air bags are forced to carry the full load of the axles and the wheel assemblies, which results in damage to the air bags.

There is a need for a method and apparatus for lifting a trailer that will protect the trailer's suspension system from damage when the trailer is lifted by an overhead crane.

Therefore it is an object of the present invention to provide a method and apparatus for lifting a trailer that will protect the trailer's suspension system from damage when the trailer is lifted by an overhead crane.

This object is achieved by providing a method and apparatus for lifting a trailer that maintains the axle of the trailer in a fixed position while the trailer is being lifted. The method and apparatus of the present invention involves connecting a retaining means between the lift shoes of the overhead crane and the axles or wheel assemblies of the trailer to maintain the axles in a fixed vertical position while the trailer is being lifted. In the preferred embodiment, the retaining means is a wedge member that is installed between the two outside tires of the rear tandem axle. The wedge member hangs from a chain or cable attached to the lift shoe of overhead crane, and is spring biased in an upward direction so as to snugly wedge between the two outside tires.

The present invention provides significant advantages over the prior art, including: (1) trailers can be lifted while maintaining the wheel assemblies in a fixed position; (2) the components of the present invention only have to bear the weight of the axle and wheel assemblies; (3) at no time during the lifting process do the components of the present invention bear the entire weight of the trailer; (4) trailers with air ride suspension systems can be lifted without stretching or damaging the air bags; and (5) lifted trailers with air ride suspension systems can be set down without misaligning the air bags.

The above as well as additional objectives, features, and advantages will become apparent in the following description.

BRIEF DESCRIPTION OF THE DRAWINGS

The novel features believed characteristic of the invention are set forth in the appended claims. The invention itself however, as well as a preferred mode of use, further objectives and advantages thereof, will best be understood by reference to the following detailed description of the preferred embodiment when read in conjunction with the accompanying drawings, wherein:

DETAILED DESCRIPTION OF THE INVENTION

The method and apparatus of the present invention involves connecting a retaining means between the lift shoes of an overhead crane and the axles, wheel assemblies, or tires of a trailer to maintain the axles in a fixed vertical position while the trailer is being lifted. In the preferred embodiment, the presenting invention includes a retaining means for retaining the axles of a trailer in a fixed position and a connecting means for connecting the retaining means to the lift shoe of an overhead crane.

Figure 1:
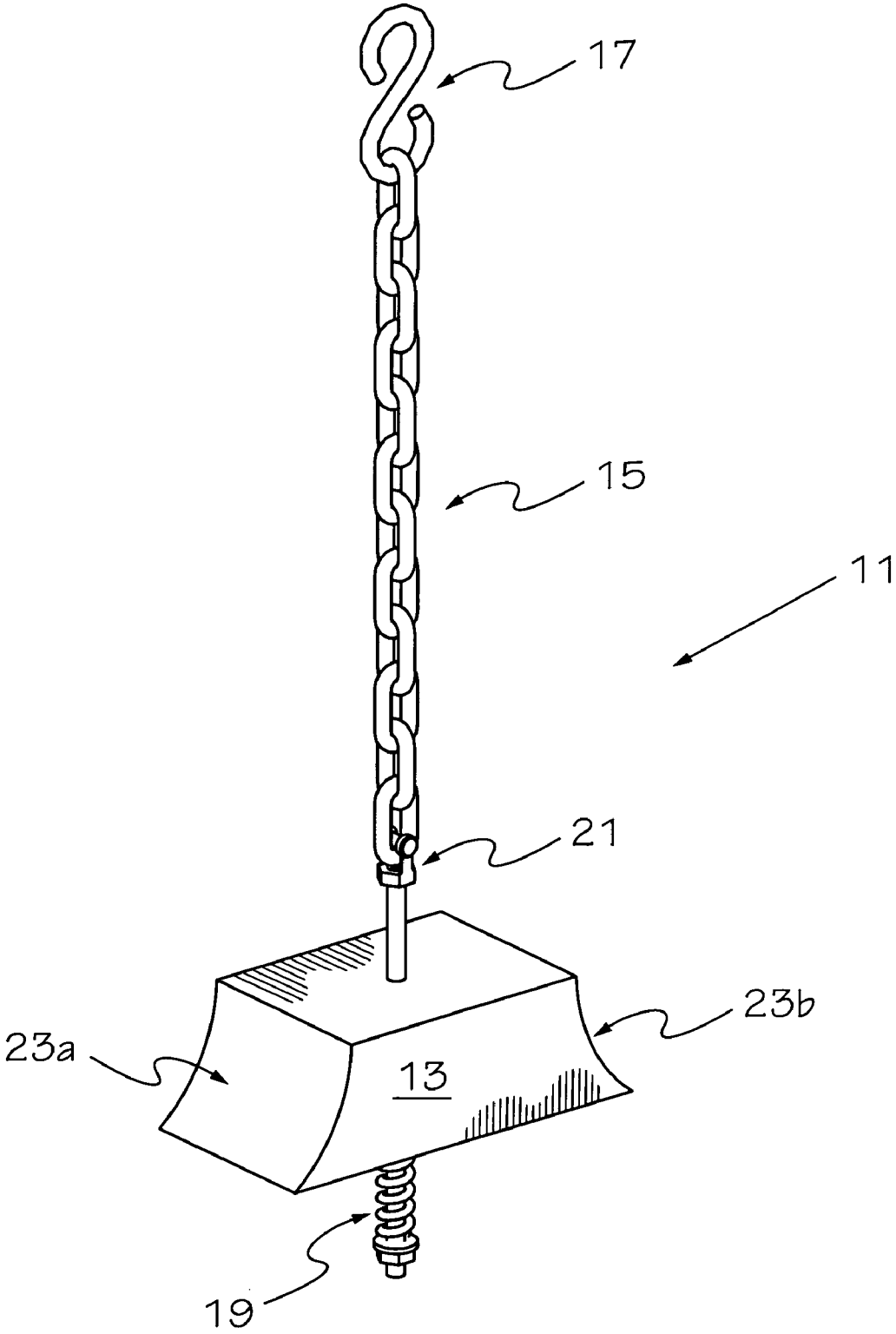
FIG. 1 is a perspective view of the apparatus for lifting a trailer according to the present invention.
Figure 2:
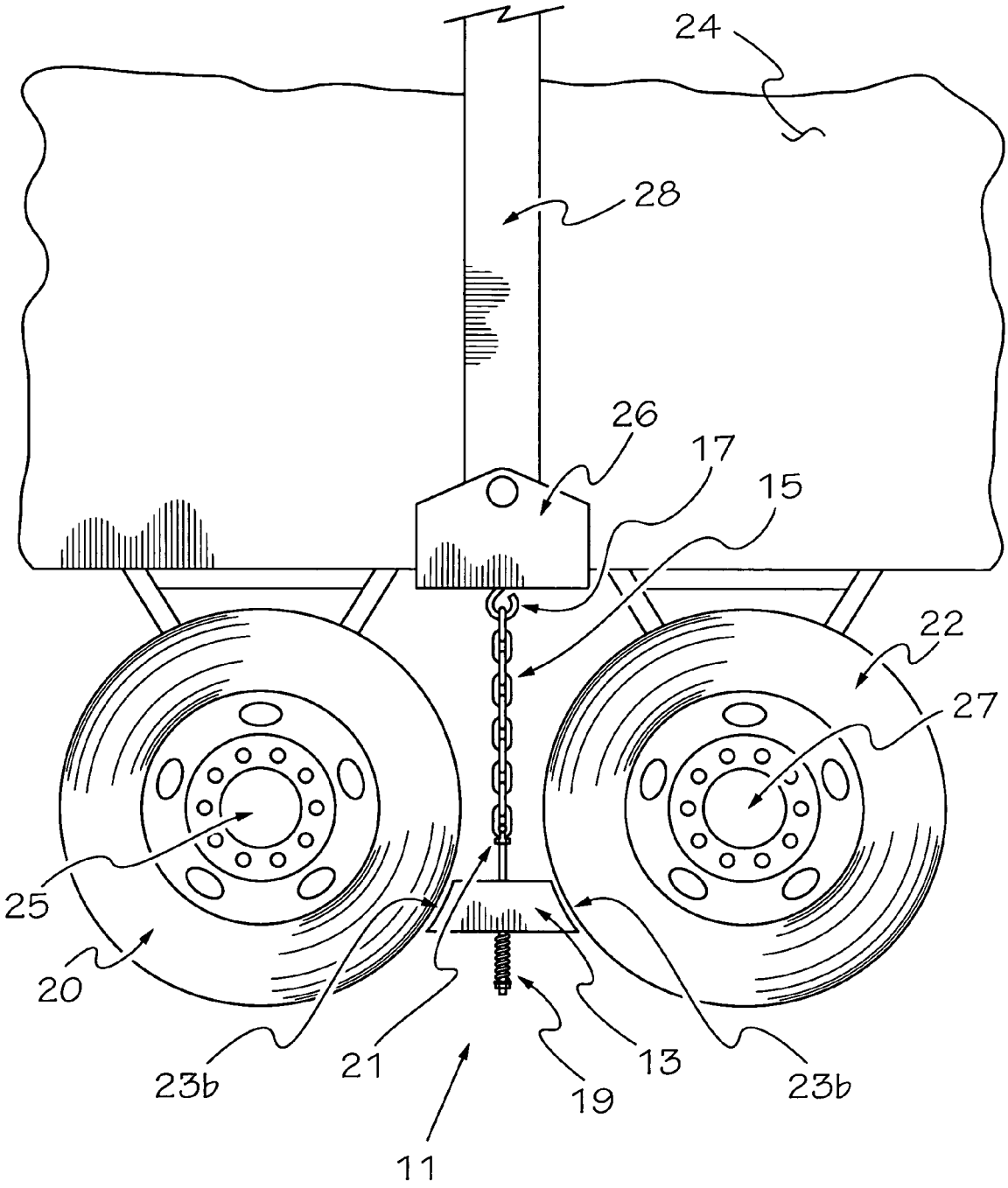
FIG. 2 is a side view of the apparatus of FIG. 1 installed onto an overhead crane and trailer having an air ride suspension system.

Referring to FIGS. 1 and 2 in the drawings, an apparatus 11 for lifting trailers according to the present invention is illustrated. Apparatus 11 includes a retaining means 13, an extension means 15, a connection means 17, and an adjustment member 19. It is preferred that retaining means 13 form a wedge member that is configured to fit snugly between outside rear tires 20 and 22 on a tandem-axle trailer 24. Connection means 17 is preferably a hook or latch member adapted to connect extension means 15 to a lift shoe 26 of an overhead crane 28. Extension means 15 is preferably a chain or cable member that connects retaining means 13 to connection means 17. Adjustment means 19 is preferably a spring that wedgingly biases retaining means 13 between tires 20 and 22. Extension means 15 may include a coupling member 21 for coupling extension means 15 to adjustment means 19.

As is shown in FIG. 1, wedge member 13 may be a generally triangular shaped or rhombus shaped block, and is preferably made of a rigid material, such as ultra high molecular weight polyethylene, although wedge member may also be made of wood or metal. It will be appreciated that the inclined ends 23*a* and 23*b* of wedge member 13 may be curved to better conform the circular perimeter of tires 20 and 22. In addition, it should be understood that the surfaces of ends 23*a* and 23*b* may be coated or treated so as to roughen the surfaces to provide more friction between wedge member 13 and tires 20 and 22.

Figure 3:
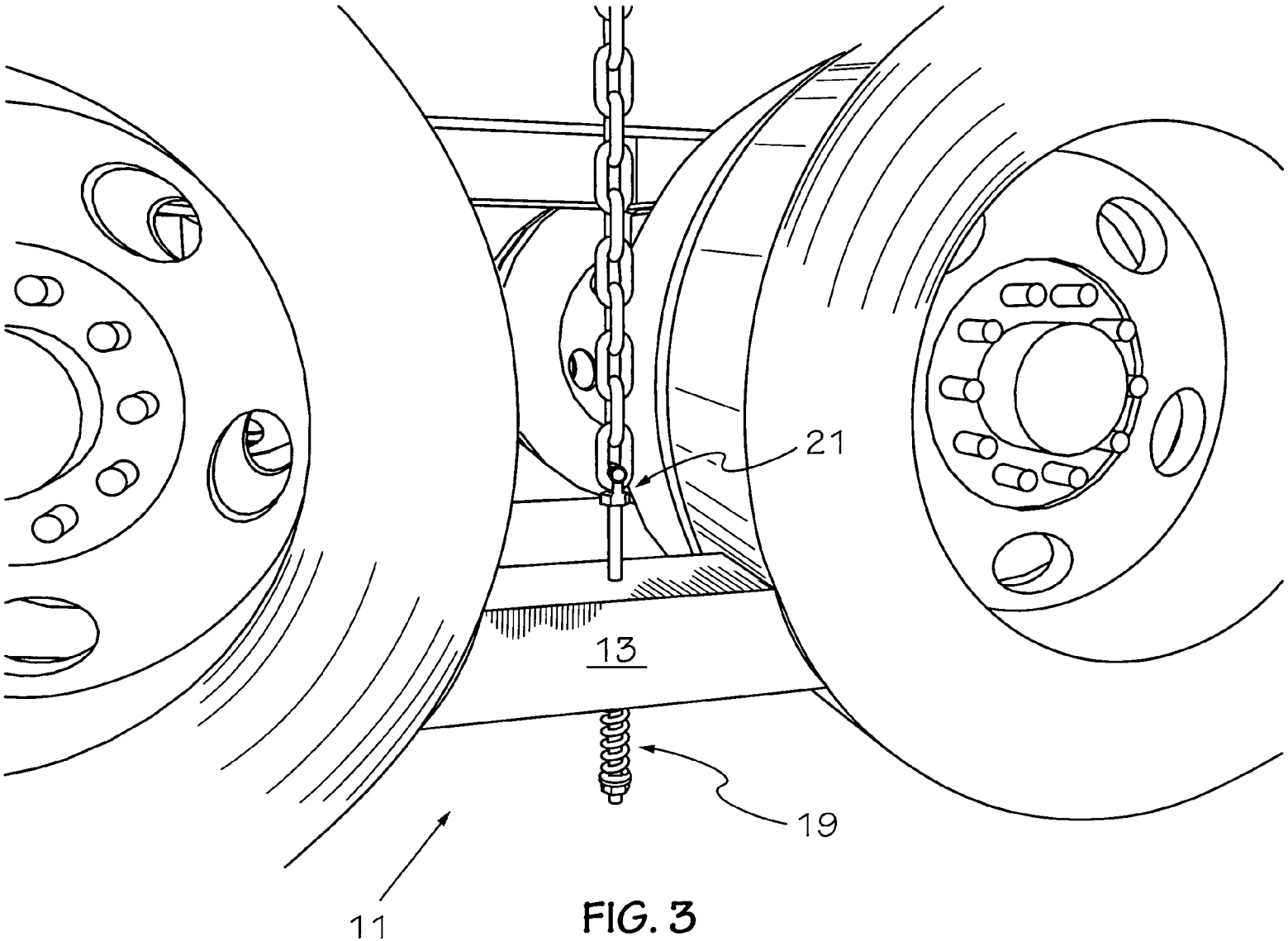
FIG. 3 is a perspective view of the apparatus of FIG. 1 being installed between the outside tires of the rear tandem axle of a trailer.
Figure 4:
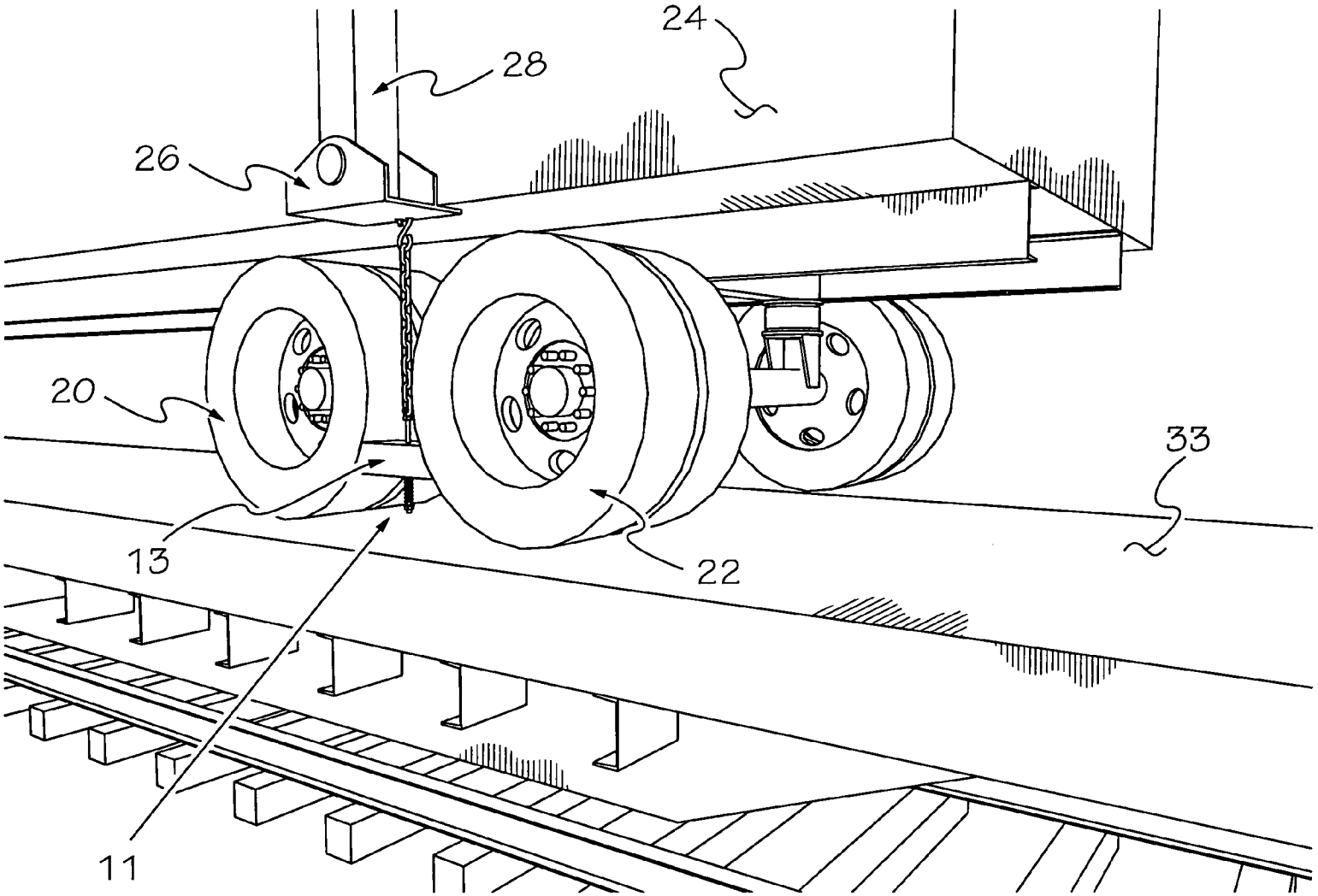
FIG. 4 is a perspective view of the apparatus of FIG. 1 installed onto an overhead crane and trailer having an air ride suspension system showing the trailer being loaded onto a flatbed railcar.

Referring now to FIGS. 3 and 4 in the drawings, the installation procedure of apparatus 11 is illustrated. To install apparatus 11, chain 15 is connected to lift shoe 26 by hook 17 at an appropriate location on chain 15. In the preferred embodiment, hook 17 is coupled to the lower surface of lift shoe 26, and chain 15 has a sufficient length to accommodate different lengths between lift shoe 26 and tires 20 and 22, as this length may vary depending upon the manufacturer of trailer 24 and the condition of the suspension system of trailer 24. After chain 15 is connected to hook 17, wedge member 13 is pushed downward against spring 19 to allow wedge member 13 to be inserted between tires 20 and 22. Once wedge member 13 is inserted between tires 20 and 22, wedge member 13 is released, thereby allowing spring 19 to bias ends 23*a* and 23*b* against the outer circular surfaces of tires 20 and 22. Then, overhead crane 28 lifts trailer 24. As trailer 24 is lifted, tires 20 and 22, along with the tandem axles 25 and 27, and the remaining portions of the wheel assemblies are prevented from moving downward due to the compression of tires 20 and 22 against wedge member 13. It is preferred that wedge member 13 be configured such that spring 19 carries no load from tires 20 and 22, or axles 25 and 27.

As is shown in FIG. 4, trailer 24 is then loaded onto a flatbed railcar 33 so that trailer 24 may be transported over rails. After trailer 24 is unloaded from flatbed railcar 33, the installation steps described above are performed in reverse order to remove apparatus 11 from trailer 24.

Figure 5:
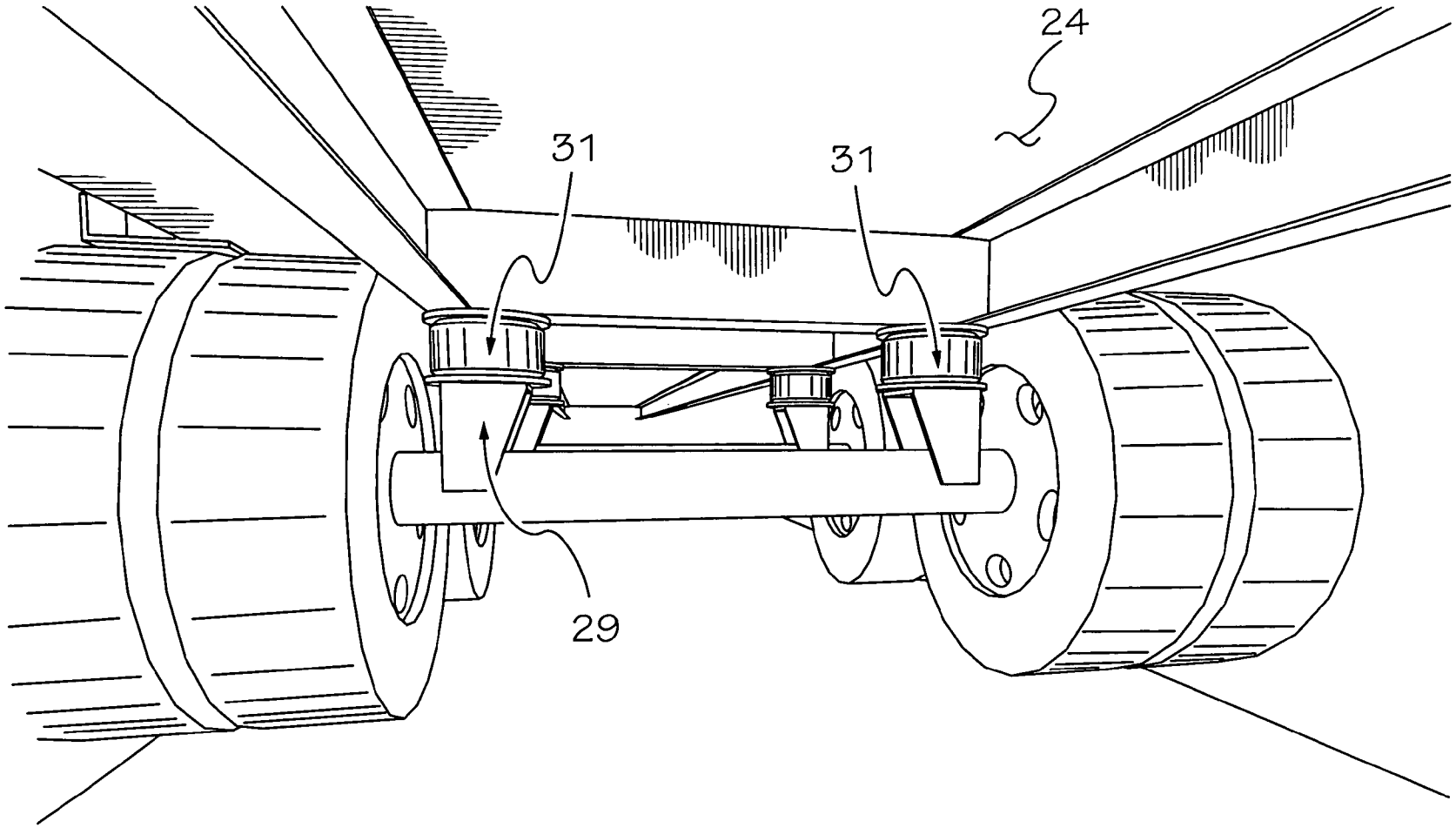
FIG. 5 is a perspective view of the apparatus of FIG. 1 installed onto an overhead crane and trailer having an air ride suspension system illustrating how the air ride suspension system is held in place while the trailer is lifted.

Referring now to FIG. 5 in the drawings, trailer 24 is shown in a perspective view from below that illustrates how an air ride suspension system 29 having air bags 31 is held in place as trailer 24 is lifted by overhead crane 28. In this manner, apparatus 11 prevents air bags 31 from stretching and being damaged during the lifting operation. In addition, apparatus 11 prevents air bags 31 from being misaligned as trailer 24 is set back down again. For these reasons, the present invention is particularly well suited for use with trailers 24 having air ride suspension systems 29. However, it will be appreciated that the method and apparatus of the present invention may be used with any tandem axle trailer in which it is desired that the axles be held in a fixed vertical position during lifting.

It will be appreciated that the present invention may be utilized in one or more alternate embodiments. For example, retaining means 13 may be configured to engage only one tire, or to engage two tires by connecting around the outside of the tires, such as by a reverse wedge. In addition, extension means 15 may be a rigid member that is hingedly or pivotally connected to the lift shoe and pivoted down or around, such that the wedge member engages the tires, either between the tires or on the outside of the tires.

It is clear that the present invention provides significant advantages over the prior art, including: (1) trailers can be lifted while maintaining the wheel assemblies in a fixed position; (2) the components of the present invention only have to bear the weight of the axle and wheel assemblies; (3) at no time during the lifting process do the components of the present invention bear the entire weight of the trailer; (4) trailers with air ride suspension systems can be lifted without stretching or damaging the air bags; and (5) lifted trailers with air ride suspension systems can be set down without misaligning the air bags.

It is apparent that an invention with significant advantages has been described and illustrated. Although the present invention is shown in a limited number of forms, it is not limited to just those forms, but is amenable to various changes and modifications without departing from the spirit thereof.

Although the invention has been described with reference to a particular embodiment, this description is not meant to be construed in a limiting sense. Various modifications of the disclosed embodiments as well as alternative embodiments of the invention will become apparent to persons skilled in the art upon reference to the description of the invention. It is therefore contemplated that the appended claims will cover any such modifications or embodiments that fall within the scope of the invention.

What is claimed is:

1. A lifting apparatus for use in lifting a trailer from a railcar, wherein said trailer includes a tandem rear axel with wheel assemblies having tires coupled thereto, for use in combination with an overhead crane having a plurality of lifting shoes for engaging said trailer at a plurality of lifting points, comprising:

(a) a connector member for connecting said lifting apparatus to a lower portion of particular ones of said plurality of lifting shoes;

(b) a retaining member for engaging said tandem rear axel and a particular one of said wheel assemblies in order to secure said particular one of said wheel assemblies in a fixed position and to bear the weight of said tandem rear axel and said wheel assemblies;

(c) an adjustment member for determining an amount of engagement between said retaining member and said tandem axel and said particular one of said wheel assemblies, wherein said adjustment member comprises a mechanical biasing subassembly which urges said retaining member into mechanical engagement with said tandem rear axels with wheel assemblies; and (d) a mechanical linkage for mechanically connecting said connector member, said retainer member and said adjustment member.

2. A lifting apparatus according to claim 1, wherein said connector member comprises a hook for connecting said lifting apparatus to said overhead crane.

3. A lifting apparatus according to claim 1 wherein said connector member provides a releasable connection between said lifting apparatus and said overhead crane.

4. A lifting apparatus according to claim 1 wherein said connector member connects said lifting apparatus to a particular lifting shoe of said overhead crane.

5. A lifting apparatus according to claim 1 wherein said retaining member is adapted in size and shape to fit snugly between two tires of a particular one of said wheel assemblies.

6. A lifting apparatus according to claim 5 wherein said retaining member is adapted in size and shape to fit snugly between two particular outer tires of a particular one of said wheel assemblies.

7. A lifting apparatus according to claim 1 wherein said retaining member is a formed form at least one of the following materials:

(1) ultra high molecular weight polyethylene;

(2) wood;

(3) metal.

8. A lifting apparatus according to claim 1 wherein said retaining member is generally triangular in shape.

9. A lifting apparatus according to claim 1 wherein said retaining member is generally rhombus shaped.

10. A lifting apparatus according to claim 1 wherein said retaining member is a wedging member which is wedged between a particular pair of tires of a particular one of said wheel assemblies.

11. A lifting apparatus according to claim 1 wherein said retaining member includes at least one inclined outer surface in order to engage at least a portion of at least one outer surface of a tire of a particular one of said wheel assemblies.

12. A lifting apparatus according to claim 1 wherein said retaining member includes at least one roughened outer surface in order to frictionally engage at least a portion of at least one outer surface of a tire of a particular one of said wheel assemblies.

13. A lifting apparatus according to claim 12 wherein said at least one roughened outer surface is coated in order to increase said frictional engagement.

14. A lifting apparatus according to claim 12 wherein said at least one roughened outer surface is treated in order to increase said frictional engagement.

15. A lifting apparatus according to claim 1 wherein said mechanical biasing member includes:

(1) a spring which biases said retaining member upward;

(2) said spring being located at a distal end of said lifting apparatus;

(3) said spring being carried in a shaft which extends through said retaining member.

16. A lifting apparatus according to claim 1 wherein said mechanical linkage comprises at least one of:

(1) a chain;

(2) a cable;

(3) a rigid elongated arm member.

* * * * *